US005859399A

United States Patent [19]

Perret

[11] Patent Number: 5,859,399

[45] Date of Patent: Jan. 12, 1999

[54] CIRCUIT BREAKER HAVING SEMI-MOVING PISTON

[75] Inventor: Michel Perret, Bourgoin-Jallieu, France

[73] Assignee: GEC Alsthom T & D SA, Paris, France

[21] Appl. No.: 976,618

[22] Filed: Nov. 24, 1997

[30] Foreign Application Priority Data

Nov. 28, 1996 [FR] France ..... 96 14587

[51] Int. Cl.[6] ..... H01H 33/91

[52] U.S. Cl. ..... 218/60

[58] Field of Search ..... 218/43, 48, 51, 218/53, 57, 59, 60, 61, 62, 63, 65, 66, 68, 72, 74, 76, 78, 84

[56] References Cited

U.S. PATENT DOCUMENTS

| | | | |
|---|---|---|---|
| 4,511,775 | 4/1985 | Korner et al. | 200/148 A |
| 4,556,767 | 12/1985 | Egli et al. | 200/148 A |
| 4,945,197 | 7/1990 | Thuries et al. | 200/148 A |
| 5,001,314 | 3/1991 | Thuries et al. | 200/148 B |

FOREIGN PATENT DOCUMENTS

| | | | |
|---|---|---|---|
| 0591039 A1 | 4/1994 | European Pat. Off. | H01H 33/91 |
| 0664552 A1 | 7/1995 | European Pat. Off. | H01H 33/91 |
| 0701264 A1 | 3/1996 | European Pat. Off. | H01H 33/91 |
| 2349331 | 4/1975 | Germany | H01H 33/74 |

*Primary Examiner*—Michael A. Friedhofer

*Attorney, Agent, or Firm*—Sughrue, Mion, Zinn, Macpeak & Seas, PLLC

[57] ABSTRACT

A puffer type circuit breaker comprising a compression chamber closed by a pressure wall of a semi-moving piston, a first mechanism for preventing the piston from moving during a first portion of the opening displacement of the moving contact assembly, and a second mechanism for axially displacing the piston together with the moving contact assembly during the second portion of the same displacement. The piston includes a cylindrical guide portion secured to the wall. The first mechanism comprises an abutment member disposed between the end of the guide portion of the piston and a fixed retaining part, said abutment member being retractable. The second mechanism comprises an arrangement for retracting the abutment member, and acting at the end of the first displacement portion.

7 Claims, 5 Drawing Sheets

CIRCUIT BREAKER HAVING SEMI-MOVING PISTON

FIELD OF THE INVENTION

The present invention relates to a circuit breaker having a semi-moving piston.

More precisely, it relates to a puffer type circuit breaker comprising an envelope filled with a dielectric gas under pressure, two co-operating arcing contacts, at least one of which forms a portion of a moving contact assembly secured to a drive member and adapted to be displaced axially inside the envelope between a closed position and open position, the moving contact assembly being constituted by a first tube and by a second tube coaxial with the first tube to define a blast chamber and a compression chamber on opposite sides of a ring inter-connecting the first and second tubes, the compression chamber communicating with the blast chamber and being closed by a pressure wall of a semi-moving piston.

During an opening operation, the gas in the compression chamber is compressed because the distance between the piston and the ring separating the compression chamber from the blast chamber decreases. In known circuit breakers, the dielectric gas is compressed throughout the displacement of the moving contact assembly between the closed position and the open position. A certain amount of energy is required to displace the moving contact assembly. The quantity of energy required increases with increasing compression of the gas in the compression chamber throughout the stroke of the moving contact assembly.

In order to reduce the energy consumption of the circuit breaker during an opening operation, provision has therefore been made in recent circuit breakers for first means that prevent the piston from moving during a first portion of the displacement of the moving contact assembly between the closed position and the open position, and for second means that displace the piston axially with the moving contact assembly during a second portion of said displacement of the moving contact assembly.

When low currents are to be interrupted, arc extinction takes place between the arcing contacts during an opening operation with the help of gas being compressed in the compression chamber. It happens that the flow of gas coming from the compression chamber extinguishes the arc before the end of the displacement of the moving contact assembly. Consequently, it is not necessary to compress the gas in the compression chamber throughout the displacement of the moving contact assembly. Providing the piston moves with the moving contact assembly, the quantity of energy required to drive the moving contact assembly is greatly reduced since gas is no longer being compressed.

BACKGROUND OF THE INVENTION

Such a circuit breaker is described in patent document FR-A-2 696 274 filed on Sep. 29, 1992, by the Applicant.

According to that document, the first means for preventing the piston from moving are constituted by a spring disposed between the drive member and the piston, and by a fixed retaining member which co-operates with the piston, and the second means for displacing the piston axially are constituted by a drive member secured to the moving contact assembly, which member drives an abutment secured to the piston during the second portion of the displacement of the moving contact assembly, said abutment being disposed on the path of the drive member.

In such a circuit breaker, it turns out that the spring must be dimensioned to withstand the particularly high pressure that is exerted on the piston and that obtains within the compression chamber. Such a spring is expensive.

In addition, its force has repercussions throughout the drive and control system of the circuit breaker, which must be designed and dimensioned accordingly.

Finally, depending on the specific dimensions of the circuit breaker and on the maximum pressure that appears in the compression chamber, it is necessary to install a spring that delivers a particular force. The spring must therefore be matched and selected as a function of the type of circuit breaker.

OBJECTS AND SUMMARY OF THE INVENTION

The invention solves these problems by proposing first and second means which enable the energy required for an opening operation to be reduced, and which can be applied to any circuit breaker, whatever the maximum pressure in the compression chamber.

To do this, according to the invention:

said piston is constituted by said annular pressure wall and a cylindrical guide portion secured to said wall, sliding on the first tube and disposed on the side of the pressure wall remote from the contacts;

said first means comprise an abutment member disposed between the end of the guide portion of the piston and a fixed retaining part, said abutment member being retractable; and said second means comprise an arrangement for retracting said abutment member, acting at the end of the first displacement portion.

Such a device is of linear shape and of small radial extent. It is particularly suitable for long-stroke circuit-breakers. Since it occupies no radial extent, it makes it possible to use envelopes of small diameter.

The number of parts used is relatively small and they are particularly simple to machine and to assemble.

In a preferred embodiment:

said abutment member is cylindrical, prevented from moving in axial translation, and disposed around said first tube between the end of the guide portion of the piston and the fixed retaining part, said abutment member being radially expandable; and said arrangement for retracting the abutment member is an arrangement for expanding it radially, acting in such a manner as to enable the guide portion to pass between the first tube and the abutment member.

Preferably, said abutment member is constituted by at least two half-cylinders compressed one against the other by at least one annular traction spring.

Preferably, said expansion arrangement comprises at least one first rib carried by the second tube and positioned to deform the abutment member radially at the end of the first displacement portion.

Advantageously, the two half-cylinders of the abutment member comprise a first conical zone at their end in abutment with the guide portion of the piston, and a second conical zone close to their end in abutment against the fixed retaining part; and the expansion arrangement includes two annular ribs carried by the first tube, said first rib terminating its contact with the first conical zone of the half-cylinders at the end of the first displacement portion, and a second rib coming into contact with the second conical zone of the two half-cylinders when the first rib has left the first conical zone.

Advantageously, an auxiliary abutment is provided for positioning the piston in the closed position, a small amount of clearance existing between the end of the guide portion of the piston and the abutment member in this position, and a spring is disposed between the pressure wall of the piston and the ring.

BRIEF DESCRIPTION OF THE DRAWINGS

The invention is described below in greater detail with the help of figures which show a preferred embodiment only of the invention.

MORE DETAILED DESCRIPTION

Figure 1A:
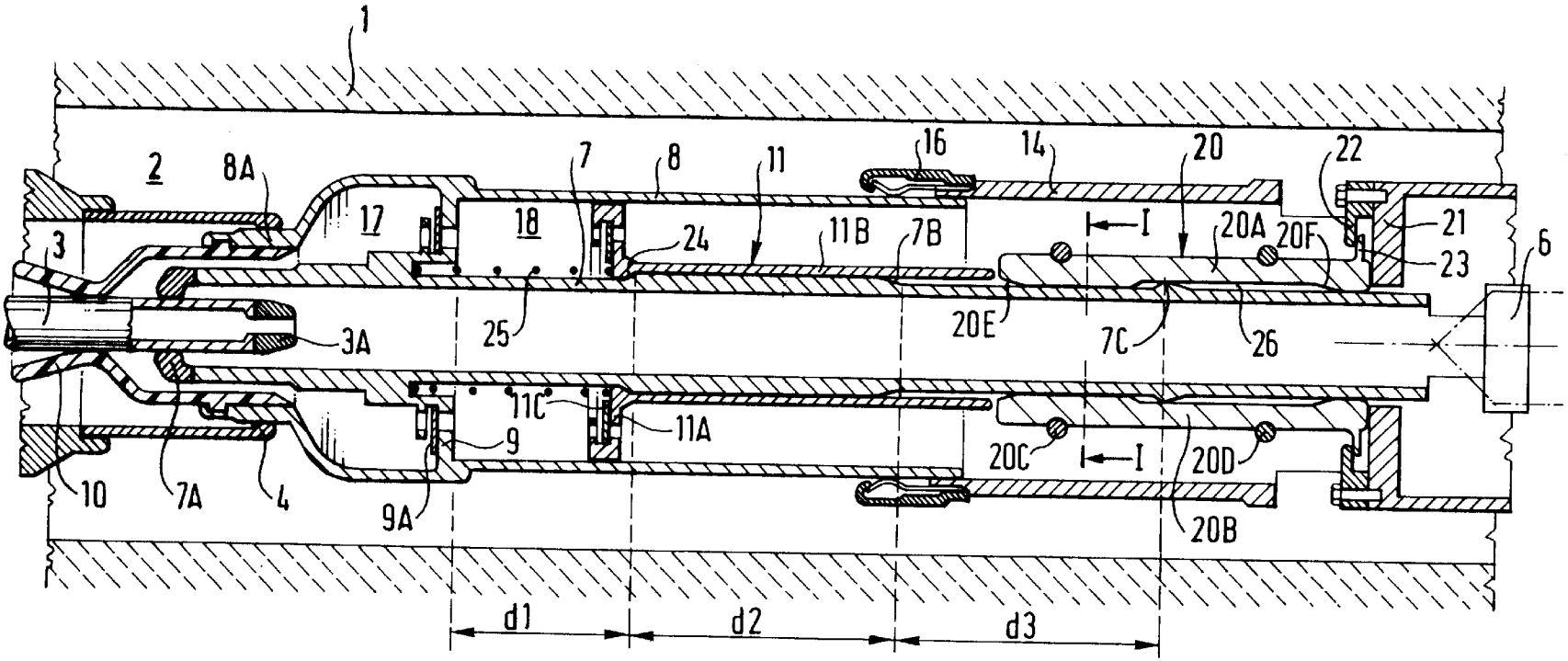
FIG. 1A is a longitudinal section view through a circuit breaker of the invention in the closed position.

In the description below, a single interrupting chamber is described, it being understood that a high voltage circuit breaker may include a plurality of interrupting chambers of the type described for each phase. In FIGS. 1A to 5B, the same references are used to designate elements that are identical.

In the figures, reference 1 designates an insulating envelope, preferably made of porcelain, defining an expansion chamber 2 filled with a gas having good dielectric properties, for example sulfur hexafluoride at a pressure of a few bars.

The circuit breaker comprises a fixed assembly and a moving contact assembly.

The fixed assembly comprises an arcing contact 3 constituted by a metal tube whose end 3A is made of a material that withstands the effects of arcing, for example a tungsten-based alloy. The fixed assembly also comprises a fixed permanent contact 4 constituted by fingers. The arcing contact and the fixed permanent contact are electrically connected to a first current terminal (not shown).

The moving contact assembly comprises a drive part 6 passing through the chamber 2 in sealed manner and connected to a mechanism (not shown). The part 6 is connected to a metal assembly comprising two coaxial tubes 7 and 8, the tube 8 being larger in diameter than the tube 7. The tubes 7 and 8 are connected together by a metal ring 9.

The tube 7 constitutes the moving arcing contact. Its end 7A is made of a material that withstands the effects of arcing and it co-operates with the contact 3–3A. The tube 8 carries a blast nozzle 10 of insulating material. A tubular end portion 8A of the second tube 8 constitutes the permanent moving contact of the circuit breaker and, when the circuit breaker is in its closed position, it co-operates with the fingers 4, as can be seen in FIG. 1A.

The end 8A of the tube 8, the blast nozzle 10, the tube 7, and the ring 9 together define a blast chamber 17. The ring 9, the tubes 7 and 8, and a pressure wall 11A of a piston 11 together define a compression chamber 18 that is separated from the blast chamber by the ring 9. The pressure wall 11A of the piston 11 slides axially between the tubes 7 and 8 in sealed manner.

The second tube 8 slides on a fixed tube 14. The tube 14 is electrically connected to a second current terminal (not shown). The tube 14 also supports a permanent contact constituted by fingers 16 in electrical contact with the tube 8.

The piston 11 is fitted with a non-return valve 11C enabling gas to flow from the interrupting chamber 2 to the blast chamber 17 so as to enable the blast chamber 17 to be filled during a closing operation. The ring 9 is fitted with a non-return valve 9A allowing gas to flow from the compression chamber 18 to the blast chamber 17.

More precisely, the piston 11 is constituted by the annular pressure wall 11A and a cylindrical guide portion 11B secured to said wall 11A, slidably mounted on the first tube 7, and disposed on the side of the pressure wall 11A that is remote from the contacts.

First means are provided for preventing the piston from moving during a first portion of the displacement of the moving contact assembly between the closed position and the open position, and corresponding to the compression displacement, and second means are provided for moving the piston axially together with the moving contact assembly during a second portion of the same displacement of the moving contact assembly.

The first means comprise an abutment member 20 disposed between the end of the guide portion 11B of the piston and a fixed retaining part 21. This abutment member 20 is retractable.

Figure 1B:
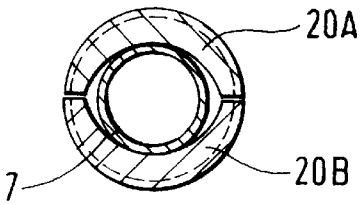
FIG. 1B is a cross-section on line I—I of FIG. 1A.
Figure 2:
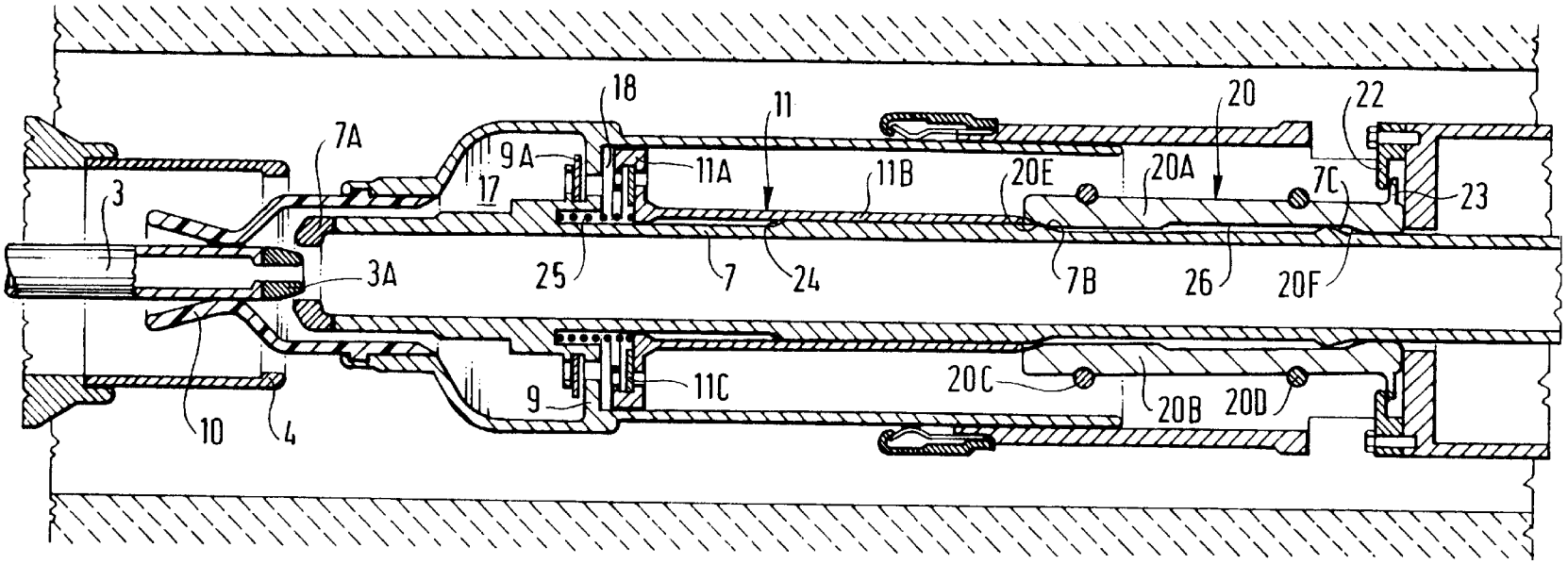
FIG. 2 is a longitudinal section view through a circuit breaker of the invention in the end-of-compression position.
Figure 5A:
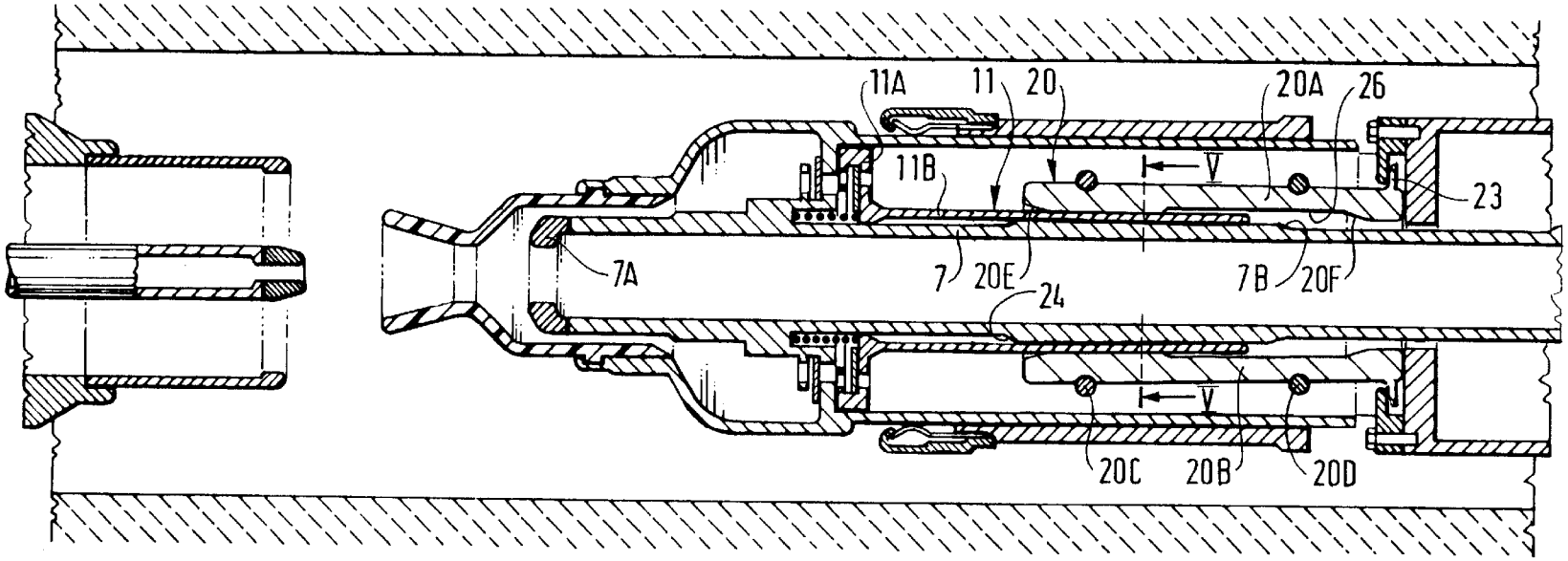
FIG. 5A is a longitudinal section view of a circuit breaker of the invention in the open position.
Figure 5B:
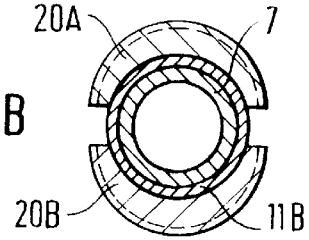
FIG. 5B is a cross-section on V—V of FIG. 5A.

More precisely, in the preferred embodiment, the abutment member 20 is cylindrical and is prevented from moving in axial translation in one direction by coming into abutment against the retaining piece 21, and in the other direction by coming into abutment against an annular spur 23 secured to the abutment member 20 and engaging a fixed catch part 22. It is disposed around said first tube 7 between the end of the guide portion 11B of the piston and the retaining part 21, and it is expandable radially. As shown in FIGS. 1B and 5B, it is constituted by two half-cylinders 20A and 20B that are compressed against each other by two annular traction springs 20C and 20D.

The two half-cylinders 20A and 20B of the abutment member include a conical first zone 20E at their end that comes into abutment with the guide portion 11B of the piston, and a second conical zone 20F in the vicinity of their end in abutment against the fixed part 21.

The second means comprise an arrangement for retracting the abutment member 20, which arrangement acts at the end of the first displacement portion.

The arrangement for retracting the abutment member 20 is preferably an arrangement for radially expanding it, acting in such a manner as to enable the guide portion 11B to pass between the first tube 7 and the abutment member 20.

More precisely, it comprises two annular ribs 7B and 7C carried by the first tube 7, said first rib 7B deforming the abutment member 20 radially after coming into contact with the first conical zone 20E of the half-cylinders at the end of the first portion of displacement, and the second rib 7C coming into contact with the second conical zone 20F of the two half-cylinders when the first rib 7B has left the first conical zone 20E.

Structurally, the first tube 7 is machined to have different thicknesses over its portion behind the ring 9, while keeping its inside diameter constant.

Over a first distance d1, this thickness is relatively small and at the end of the distance d1, the thickness increases to form an auxiliary abutment 24. The function of the auxiliary abutment 24 is to position the piston 11 in the closed position, as shown in FIG. 1A. In this position, a small amount of clearance exists between the end of the guide portion 11B of the piston and the abutment member 20. During an operation for closing and filling the compression chamber 18, the piston 11 is pushed against said abutment 24 by a spring 25 disposed between the pressure wall 11A of the piston and the ring 9. The size of the spring 25 and the force it provides are small, since it serves only for positioning purposes, and it is subject to relatively small gas pressure only.

At a second distance d2 from said auxiliary abutment 24, the thickness of the tube 7 is again reduced to form the first rib 7B whose function is defined above. Advantageously, it constitutes a conical abutment surface.

At a third distance d3 from said first rib 7B, there is disposed the second rib 7C whose function is specified above. Designed to apply force to the abutment member 20 only after the end of the first portion of the displacement of the moving assembly, i.e. after compression, it moves during said first portion of the displacement in a gap 26 provided in the abutment member 20. The gap 26 is terminated by the second conical zone 20F.

An opening operation takes place as follows.

In the closed position as shown in FIG. 1A, the contacts 3A and 7A are in the inserted position, the compression chamber 18 is full of gas, and the piston 11 is in abutment against the auxiliary abutment 24, in its position furthest from the ring 9.

During the opening operation, the moving assembly is displaced to the right (as shown in the figure) and very quickly the end of the guide portion 11B of the piston comes into abutment against the abutment member 20 which is fixed in translation, the initial clearance between these two elements being small.

Throughout the first portion of the displacement, the piston 11 is thus held fixed by the abutment member 20. The volume of the compression chamber 18 is reduced and the gas compressed therein is injected into the blast chamber 17. At the end of compression, the circuit breaker is in the position shown in FIG. 2. The first rib 7B ends contact against the first conical zone 20E and begins to expand the two half-cylinders 20A and 20B of the abutment member 20 radially.

Figure 3:
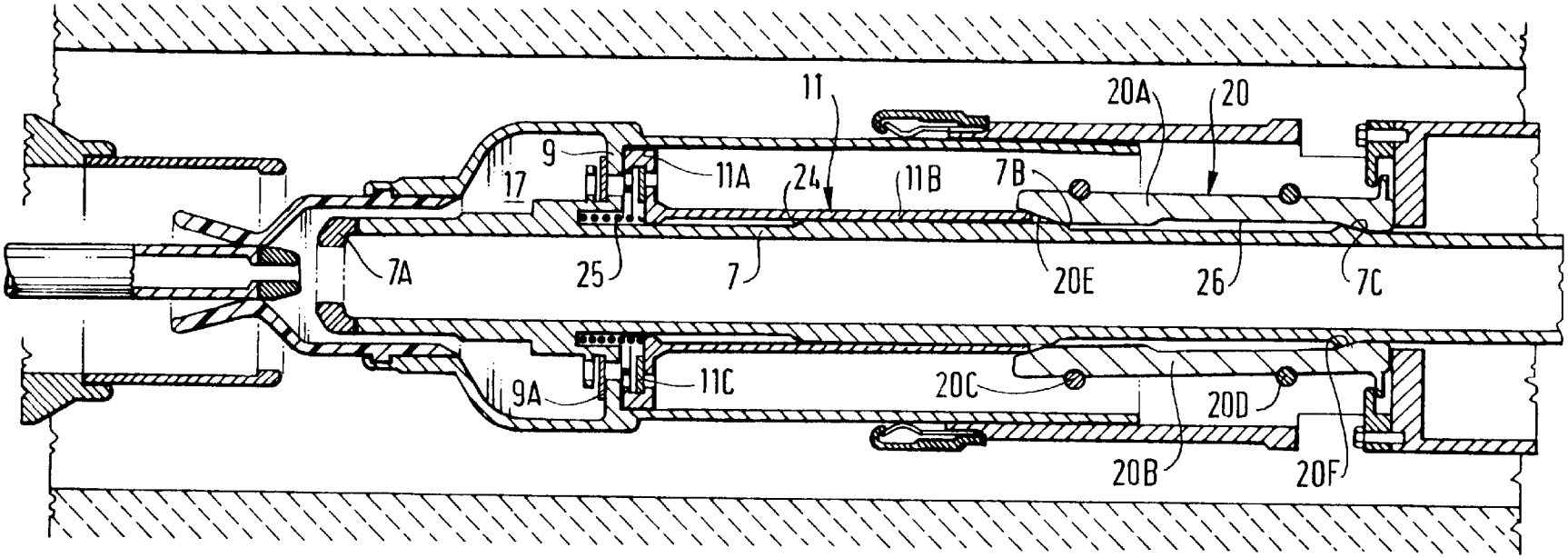
FIG. 3 is a longitudinal section view of a circuit breaker of the invention in a first intermediate position later than the end-of-compression position.
Figure 4:
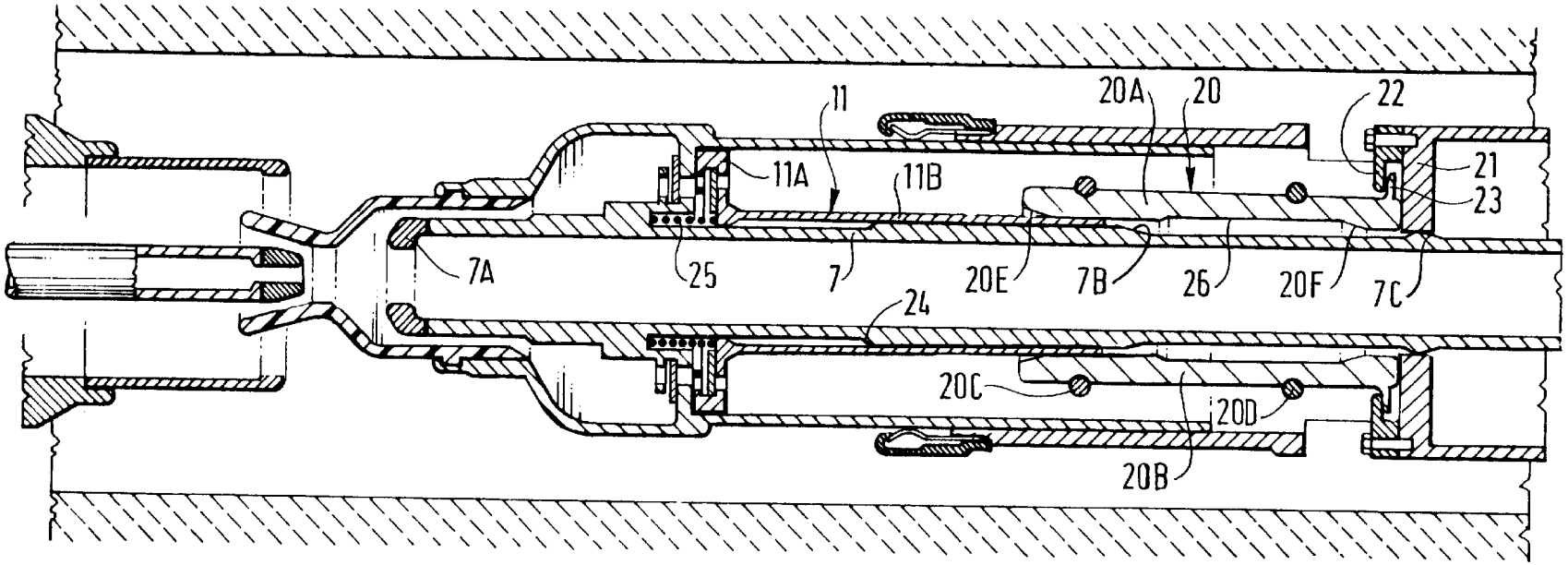
FIG. 4 is a longitudinal section view through a circuit breaker of the invention in a second intermediate position later than the end-of-compression position.

Once this first conical zone 20E has been passed, as shown in FIG. 3, the end of the guide portion 11B of the piston 11 begins to be able to penetrate between the first tube 7 and the abutment member 20, and the second rib 7C comes into abutment against the second conical zone 20F. Continuing displacement causes the abutment member 20 to be fully expanded radially, enabling the guide portion 11B to pass between the first tube 7 and the abutment member 20.

In the example shown in FIG. 3 et seq., the pressure wall 11A is in abutment against the ring 9 at the end of compression, since the volume of the compression chamber 18 is zero at the end of compression. Pushed by the ring 9, the piston 11 therefore continues to move with the moving assembly until the open position shown in FIG. 5A is reached, with the abutment member 20 providing no resistance to such displacement.

By giving different dimensions to the component elements of the circuit breaker, and in particular the guide portion 11B of the piston 11 and the spring 25, it is possible to reach the end of compression prior to the pressure wall 11A coming into abutment against the ring 9, thereby conserving a residual volume in the compression chamber 18.

I claim:

1. A puffer type circuit breaker, comprising:

an envelope filled with a dielectric gas under pressure;

a moving contact assembly secured to a drive member and axially movable to be displaced between a closed position and an open position inside the envelope;

two cooperating arcing contacts, at least one of said two cooperating arcing contacts forming a portion of the moving contact assembly;

wherein the moving contact assembly comprises:

a semi-moving piston having an annular pressure wall;

a first tube;

a second tube coaxial with the first tube to define a blast chamber and a compression chamber on opposite sides of a ring interconnecting the first and second tubes, the compression chamber communicating with the blast chamber and being closed by the pressure wall of the semi-moving piston;

first means being provided for preventing the piston from moving during a first portion of the displacement of the moving contact assembly between the closed position and the open position; and second means being provided for displacing the piston axially together with the moving contact assembly during a second portion of said displacement of the moving contact assembly; and wherein said piston further comprises a cylindrical guide portion secured to said annular pressure wall, said piston slidable on the first tube and disposed on a side of the pressure wall remote from the contacts;

said first means comprise an abutment member disposed between an end of the guide portion of the piston and a fixed retaining part so that the abutment member abuts the end of the guide portion of the piston during at least a part of the first portion of the displacement of the moving contact assembly, said abutment member being expandable so as not to abut the end of the guide portion of the piston when expanded; and said second means comprise an arrangement for expanding said abutment member, acting at an end of the first displacement portion.

2. A circuit breaker according to claim 1, further comprising a securing mechanism for preventing said abutment member from axially moving; and wherein:

said abutment member is cylindrical and disposed around said first tube between the end of the guide portion of the piston and the fixed retaining part, said abutment member being radially expandable; and said arrangement for expanding the abutment member is an arrangement for expanding it radially so as to enable the guide portion to pass between the first tube and the abutment member.

3. A circuit breaker according to claim 2, wherein said abutment member comprises at least two half-cylinders compressed one against the other by at least one annular traction spring.

4. A circuit breaker according to claim 1, wherein said arrangement for expanding said abutment member comprises at least one first rib carried by the second tube and positioned to deform the abutment member radially at the end of the first displacement portion.

5. A circuit breaker according to claim 4, wherein said abutment member comprises at least two half-cylinders; and wherein:

each of the two half-cylinders of the abutment member comprise a first conical zone at respective ends of the two half-cylinders in abutment with the guide portion of the piston, and a second conical zone at respective ends of the two-half cylinders in abutment against the fixed retaining part; and the expansion arrangement includes two annular ribs carried by the first tube, said first rib being in contact with the first conical zone of the half-cylinders at least during a part of the first displacement portion, and a second rib coming into contact with the second conical zone of the two half-cylinders when the first rib has cleared the first conical zone.

6. A circuit breaker according to claim 1, wherein an auxiliary abutment is provided for positioning the piston in the closed position, wherein a clearance remains between the end of the guide portion of the piston and the abutment member while the piston is in the closed position, and wherein a spring is disposed between the pressure wall of the piston and the ring.

7. A puffer type circuit breaker, comprising:

an envelope filled with a dielectric gas under pressure;

a moving contact assembly secured to a drive member and axially movable to be displaced between a closed position and an open position inside the envelope;

two cooperating arcing contacts, at least one of said two cooperating arcing contacts forming a portion of the moving contact assembly;

wherein the moving contact assembly comprises:

a first tube;

a semi-moving piston having an annular pressure wall and a cylindrical guide portion secured to said annular pressure wall, said piston slidable on said first tube and disposed on a side of the pressure wall remote from the contacts;

a second tube coaxial with said first tube to define a blast chamber and a compression chamber on opposite sides of a ring interconnecting said first and second tubes, the compression chamber communicating with the blast chamber and being closed by the pressure wall of the semi-moving piston;

a piston stop having an abutment member disposed between an end of the guide portion of the piston and a fixed retaining part for retaining the piston stop, so that the abutment member abuts the end of the guide portion of the piston during a first portion of the displacement of the moving contact assembly between the closed position and the open position so as to prevent the piston from moving during the first portion of the displacement of the moving contact assembly, said abutment member further being expandable so as not to abut the end of the guide portion of the piston when expanded; and a piston displacement mechanism including projections for expanding said abutment member which operate at an end of the first portion of the displacement so as to disengage said piston stop and permit the piston to be displaced axially together with the moving contact assembly during a second portion of the displacement of the moving contact assembly.

* * * * *